United States Patent [19]

Yamanashi

[11] Patent Number: 4,815,626

[45] Date of Patent: Mar. 28, 1989

[54] PULL-TAB FOR EASY-TO-OPEN CONTAINER LID

[75] Inventor: Shigeaki Yamanashi, Kawasaki, Japan

[73] Assignee: Toyo Seikan Kaisha Limited, Tokyo, Japan

[21] Appl. No.: 136,569

[22] Filed: Dec. 22, 1987

[30] Foreign Application Priority Data

Dec. 24, 1986 [JP] Japan ..... 61-197332[U]

[51] Int. Cl.[4] ..... B65D 17/34

[52] U.S. Cl. ..... 220/273

[58] Field of Search ..... 220/269–273

[56] References Cited

U.S. PATENT DOCUMENTS 3,445,029 5/1969 Zengen ..... 220/273
3,637,106 1/1972 Brown et al. ..... 220/273

FOREIGN PATENT DOCUMENTS 0012358 5/1970 Japan .
0000421 1/1980 Japan .
0098326 7/1983 Japan .

*Primary Examiner*—George T. Hall
*Attorney, Agent, or Firm*—Sandler & Greenblum

[57] ABSTRACT

A pull-tab for an easy-to-open can container is mounted on a lid provided at an opening of a partially-open type container that contains a liquid such as a refreshing beverage. The pull-tab is fixed by a rivet at a predetermined portion of a removable portion surrounded by a score provided on the lid. A dish-like or bowl-like recessed portion is formed around the peripheral edge of a rivet insertion hole of the pull-tab. The peripheral edge of the rivet insertion hole is turned upward along the peripheral wall of the recessed portion to form a horizontally turned portion. A reinforcing edge is provided around the entire peripheral edge of the pull-tab with the exception of the distal end portion at a portion thereof at which the rivet insertion hole is provided. The length of this portion at which no reinforcing edge is provided is made smaller than the outer diameter of the recessed portion. Therefore, it is possible to efficiently prevent the pull-tab coming off the rivet when the container is opened. It is also possible to reduce the thickness of the pull-tab.

5 Claims, 2 Drawing Sheets

PULL-TAB FOR EASY-TO-OPEN CONTAINER LID

BACKGROUND OF THE INVENTION

1. Field of the Invention

The present invention relates to a lid mounted on an open portion of a container body that contains a liquid such as a refreshing drink, and, more particularly, to a pull-tab for an easy-to-open container lid which is mounted on the lid.

2. Description of the Prior Art

Conventional easy-to-open containers of the above-described type are classified as being one of two types, a partial-open-type and a full-open-type. In such an easy-to-open container, a panel portion of the lid of the container is provided with a score defining a removable portion. To remove the removable portion from the panel portion of the lid and thereby open the easy-to-open container, the score is ruptured by the action of gripping and pulling upward a gripping portion of a pull-tab that is fixed to the lid by means of a rivet formed integrally therewith at a predetermined portion of the removable portion surrounded by the score, with the end of the pull-tab opposite the gripping portion acting as a support.

Recently, the pull-tabs have been made thinner with a view to promoting conservation of resources. To cope with this tendency, it was proposed in the specification of Japanese Patent Publication No. 12358/1970 that the rigidity of the pull-tab may be increased in order to prevent it from coming off the rivet by forming the portion surrounding a hole in the pull-tab through which the rivet is inserted into a bowl-like configuration. It was also disclosed in the specification of Japanese Utility Model Publication No. 421/1980 that a horizontally turned portion may be provided by turning the peripheral edge of the rivet insertion hole of the pull-tab upward so as to prevent the pull-tab from coming off the rivet. Further, Japanese Utility Model Laid-Open No. 98326/1983 proposes making the length of the distal end of the pull-tab where no turned reinforcing edge is provided to be smaller than the outer diameter of the recessed portion provided at the peripheral edge of the rivet insertion hole so as to provide sufficient strength to allow the container to be opened even if the thickness of the pull-tab is small.

The above-described proposals each have their own advantages, and are effective in providing a pull-tab having a thin wall. However, each of them also has its own problems: for example, the pull-tab disclosed in the specification of Japanese Patent Publication No. 12358/1970 has the disadvantage that the pull-tab readily comes off the rivet when the container is opened. Japanese Utility Model Publication No. 421/1980 involves the disadvantage that it requires a large amount of opening force even though it is effective in reducing the likelihood of the pull-tab coming off. The pull-tab disclosed in Japanese Utility Model Laid-Open No. 98326/1983 also suffers from the problem that the pull-tab readily comes off. Thus, there have been limitations in regard to the desire to reduce the thickness of a pull-tab.

SUMMARY OF THE IDNVENTION

Accordingly, an object of the present invention is to provide an improved pull-tab for an easy-to-open container which enables efficient prevention of the tendency for a pull-tab to come off a rivet, and which enables the thickness of a pull-tab to be reduced.

The above-described object and other objects of the present invention can be attained by providing a pull-tab for an easy-to-open container which is fixed by a rivet to a predetermined portion of a removable portion surrounded by a score provided on a lid, which comprises: one end having a hole through which the rivet is inserted; a dish-like or bowl-like recessed portion formed around the peripheral edge of the rivet insertion hole; a horizontally turned portion formed by bending the distal end of the peripheral recessed portion upward along a peripheral wall portion of the rivet; a gripping portion provided at the other end of the pull-tab away from the one end at which the rivet insertion hole is provided; and a reinforcing edge provided around the entire peripheral edge of the pull-tab with the exception of a distal end portion thereof at the one end at which the rivet insertion hole is formed, wherein the length of the portion at which no reinforcing edge is provided is made smaller than the outer diameter of the recessed portion.

DESCRIPTION OF THE PREFERRED EMBODIMENT

Figure 1:
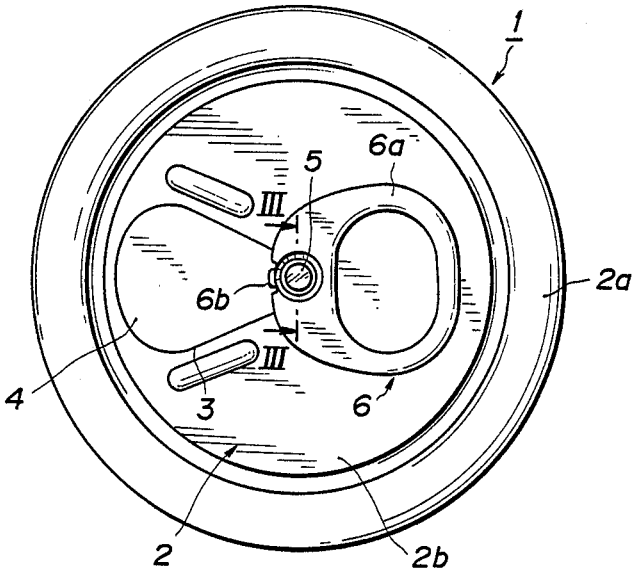
FIG. 1 is a plan view of an easy-to-open container incorporating a pull-tab according to the present invention.

An easy-to-open container 1 shown as a plan view in FIG. 1 is a so-called partial-open type can container having a lid 2 that is partially opened (at a removed portion 4 which is to be described later). The lid 2 has a flange 2*a* at its peripheral edge which is double seamed with the edge of a can body. Part of a panel portion 2*b* of the lid 2 is surrounded by a score 3 to form a removable portion 4. A rivet 5 is integrally formed with the end of the removable portion 4 (at the central portion of the lid panel portion 2*b*) in such a manner that it protrudes upward.

Figure 3:
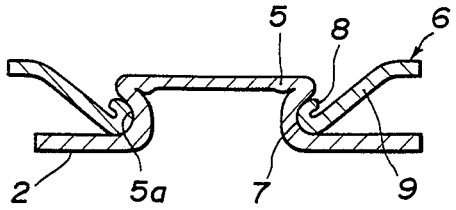
FIG. 3 is a cross-section taken along the line of III—III of FIG. 1.

A pull-tab 6 according to the present invention is provided on the lid panel 2*b* with part thereof being supported by the rivet 5. More specifically, the pull-tab 6 has a rivet insertion hole 7 at one end thereof. The peripheral edge of the rivet insertion hole 7 is bent upward along a peripheral recessed portion 5*a* of the rivet 5 to form a horizontally or upwardly inclined turned portion 8, as shown in FIG. 3. The peripheral edge of the rivet insertion hole 7 of the pull-tab 6 is also provided with a dish-like recessed portion 9, as shown in FIG. 3, which functions to increase the rigidity of the peripheral edge of the insertion hole. The proximal end of the recessed portion 9 acts as a support fulcrum when the pull-tab 6 is pulled up.

Figure 2:
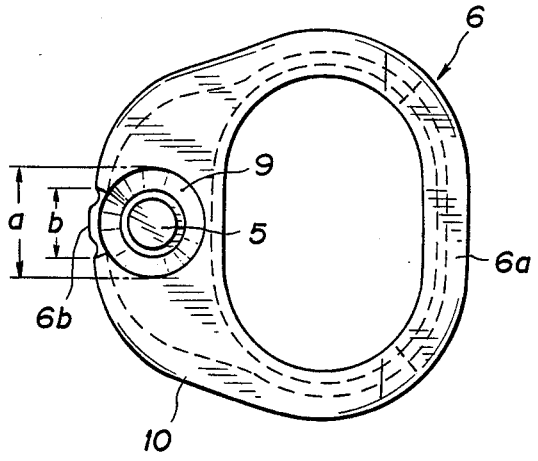
FIG. 2 is an enlarged plan view of the pull-tab of FIG. 1.

The pull-tab 6 also has a gripping portion 6*a* at the other end thereof which serves as a portion gripped by a finger and lifted up when the container is opened. The entire inner peripheral edge of the gripping portion 6*a* as well as the entire outer periphery of the pull-tab 6 with the exception of a distal end portion 6*b* thereof are turned downward to form a reinforcing edge 10 (FIG. 2). A portion of the pull-tab 6 at which no reinforcing edge 10 is formed (the distal end portion 6*b*) corresponds to a seamed portion at which the pull-tab is coupled to an adjacent one when pull-tabs are sequentially formed from a moving material wound in a coil-like shape Thus, the length b of the portion at which no reinforcing edge is formed (the distal end portion 6b) is made smaller than an outer diameter a of the recessed portion 9 (b<a).

As will be understood from the foregoing description, since the peripheral edge of the rivet insertion hole of the pull-tab is provided with a dish-like or bowl-like recessed portion according to the present invention, the rigidity of the peripheral edge of the rivet insetion hole can be increased, and, at the same time, the force required to open the removable portion can be reduced because the proximal end of the dish-like or bowl-like recessed portion acts as a support. Further, since the length of the distal end portion of the pull-tab at which no reinforcing edge is formed is set at a value which is smaller than the outer diameter of the recessed portion, sufficient strength is provided for opening the container. Further, since the peripheral edge of the rivet insertion hole of the pull-tab is turned upward to form the horizontally turned portion, coming off of the pull-tab from the rivet can be prevented. Thus, the present invention makes possible the provision of a thin pull-tab which can overcome the problems of prior art.

What is claimed is:

1. A pull-tab for an easy-to-open container which is fixed by a rivet to a predetermined portion of a removable portion surrounded by a score provided on a lid, said pull tab comprising:

one end having a rivet insertion hole through which said rivet is inserted;

a curved recessed portion formed around a peripheral edge of said rivet insertion hole;

an upwardly and outwardly turned portion formed by bending the distal end of said peripheral curved portion upwardly along a peripheral wall portion of said rivet;

a gripping portion provided at a second end of said pull-tab located away from said one end at which said rivet insertion hole is provided; and a reinforcing edge provided around the entire peripheral edge of said pull-tab with the exception of a distal end portion of said pull-tab at said one end at which said rivet insertion hole is formed, wherein the length of a portion of said peripheral edge of said pull tab at which no said reinforcing edge is provided is smaller than the outer diameter of said curved recessed portion.

2. A pull-tab according to claim 1, wherein said curved recessed portion has a substantially dish-like shape.

3. A pull-tab according to claim 1, wherein said curved recessed portion has a substantially bowl-like shape.

4. A pull-tab according to claim 1, wherein the proximal end of said curved recessed portion acts as a support fulcrum.

5. A pull-tab for an easy-to-open container, said tab being attached by a rivet to a predetermined part of a removable portion of a lid, said removable portion being defined by a score, said pull-tab comprising:

(a) a first edge having a rivet insertion hole which is adapted to receive said rivet;

(b) a curved recessed portion positioned around a peripheral edge of said rivet insertion hole;

(c) an upwardly and outwardly inclined, turned-up portion formed by bending a distal end of said peripheral curved portion upwardly along a peripheral wall portion of said rivet; and (d) a reinforcing edge provided around a predetermined portion of said peripheral edge of said pull-tab, said pull-tab peripheral edge including a predetermined portion adjacent said one end of said pull tab which is unreinforced, said unreinforced portion having a width which is greater than the diameter of said rivet, wherein the length of said unreinforced portion is smaller than the outer diameter of said curved recessed portion.

* * * * *